US007080541B2

(12) United States Patent
Xiong

(10) Patent No.: US 7,080,541 B2
(45) Date of Patent: Jul. 25, 2006

(54) AUTOMATIC FEEDING MACHINE WITH SWITCHABLE CONVEYOR

(75) Inventor: Jianping Xiong, Shenzhen (CN)

(73) Assignees: Hong Fu Jin Precision Ind(Shenzhen) Co., Ltd., Shenzhen (CN); Hon Hai Precision Ind. Co., Ltd., Taipei Hsien (TW)

( * ) Notice: Subject to any disclaimer, the term of this patent is extended or adjusted under 35 U.S.C. 154(b) by 101 days.

(21) Appl. No.: 10/863,643

(22) Filed: Jun. 7, 2004

(65) Prior Publication Data

US 2004/0244460 A1 Dec. 9, 2004

(30) Foreign Application Priority Data

Jun. 6, 2003 (TW) ..... 92210432 U

(51) Int. Cl.
*B21D 43/12* (2006.01)

(52) U.S. Cl. ..... 72/405.02; 72/404; 198/369.2

(58) Field of Classification Search ..... 72/405.01, 72/405.02, 404, 339; 198/369.2, 463.2, 573, 198/589, 592, 341.07
See application file for complete search history.

(56) References Cited

U.S. PATENT DOCUMENTS 1,747,465 A * 2/1930 Cameron ..... 72/405.02
3,516,277 A * 6/1970 Bracco et al. ..... 72/446
4,485,911 A 12/1984 Cameron
5,078,255 A * 1/1992 Haley ..... 198/358
5,640,833 A * 6/1997 Gerber ..... 53/443
5,692,593 A * 12/1997 Ueno et al. ..... 198/369.2
5,909,796 A * 6/1999 Soldavini ..... 198/369.2

* cited by examiner

*Primary Examiner*—Daniel C. Crane
(74) *Attorney, Agent, or Firm*—Wei Te Chung

(57) ABSTRACT

An automatic feeding machine for transferring semi-manufactured products (40) between a progressive die (10) and a single station die (30), includes a frame (22), a feeding device (20), and a manipulator (50). The feeding device is positioned on the frame, which includes a curved slide (24), an active conveyor (27), a passive conveyor (25), and a locating table (23). The semi-manufactured products are transported on the active conveyor, the passive conveyor and the locating table in turn. Thereafter the semi-manufactured products are fetched by the manipulator. When the passive conveyor is fully occupied with semi-manufactured products, the active conveyor pivots to a position in alignment with the curved slide, so that unneeded semi-manufactured products slide out along the curved slide.

16 Claims, 4 Drawing Sheets

AUTOMATIC FEEDING MACHINE WITH SWITCHABLE CONVEYOR

BACKGROUND OF THE INVENTION

1. Field of the Invention

The present invention relates to a feeding machine used on a manufacturing production line, and particularly to an automatic feeding machine which transfers semi-manufactured products between two dies that operate with different stamping frequencies.

2. Description of the Related Art

The stamping process of a product with a complicated structure is often completed by two sets of stamping machines. Firstly, a raw material is stamped by a progressive die to form a continuous series of discrete semi-manufactured products. Then the semi-manufactured products are transferred to a single station die to complete the stamping process. Typically, a frequency of stamping of the progressive die is greater than a frequency of processing of the single station die. Therefore the semi-manufactured product cannot be transferred from the progressive die to the single station die directly. Accordingly, either of the two following means of transferring is adopted in order to smoothly transfer the semi-manufactured products between the two dies.

The first means of transferring requires manual work by operators. A first operator removes the semi-manufactured products from the progressive die, and piles them on a worktable between the progressive die and the single station die. Then a second operator takes the semi-manufactured products away from the worktable, and puts them onto the single station die. This means of transferring is highly labor-intensive, and correspondingly inefficient.

The second means of transferring is achieved via an automatic worktable and a manipulator. Firstly, an operator removes the semi-manufactured products one by one from the progressive die, and piles them on the automatic worktable. Then the manipulator takes the semi-manufactured products away from the automatic worktable, and puts them on the single station die. Once the topmost semi-manufactured product is taken away from the automatic worktable, the next semi-manufactured product is automatically raised a predetermined height in order to facilitate the next operation. This means of transferring saves manpower. However, it is only feasible for semi-manufactured products which have a regular shape that allows them to be stacked on the worktable.

Thus, an automatic feeding machine which overcomes the above-mentioned problems is desired.

BRIEF SUMMARY OF THE INVENTION

Accordingly, an object of the present invention is to provide an automatic feeding machine with switchable conveyor which transfers semi-manufactured products between two dies that operate with different stamping frequencies.

Another object of the present invention is to provide an automatic feeding machine assembly which has high efficiency.

To achieve the above-mentioned objects, an automatic feeding machine with switchable conveyor in accordance with a preferred embodiment of the present invention comprises a frame, a feeding device, and a manipulator. The feeding device is positioned on the frame, comprising a curved slide, an active conveyor, a passive conveyor, and a locating table. The active conveyor is pivotally connected on a left side of the frame. The passive conveyor is positioned on a central of the frame. A plurality of transverse cantilevers extends from a same long side of the passive conveyor. A plurality of cylinders and sensors are assembled on each cantilever. The locating table is secured on a right end of the frame. A plurality of sensors is positioned on the locating table. Two baffle posts protrude upwardly from a right end of the locating table. The semi-manufactured products that are stamped by a progressive die slid to the active conveyor, and then are transported on the passive conveyor and the locating table in turn. Thereafter the semi-manufactured products are taken away by a manipulator to a single station die for further processing. When the passive conveyor is fully occupied with semi-manufactured products, the active conveyor pivots to a position in alignment with the curved slide, so that unneeded semi-manufactured products slide out along the curved slide.

Other objects, advantages and novel features of the present invention will be drawn from the following detailed description of a preferred embodiment of the present invention with the attached drawings, in which:

DETAILED DESCRIPTION OF THE INVENTION

Figure 1:
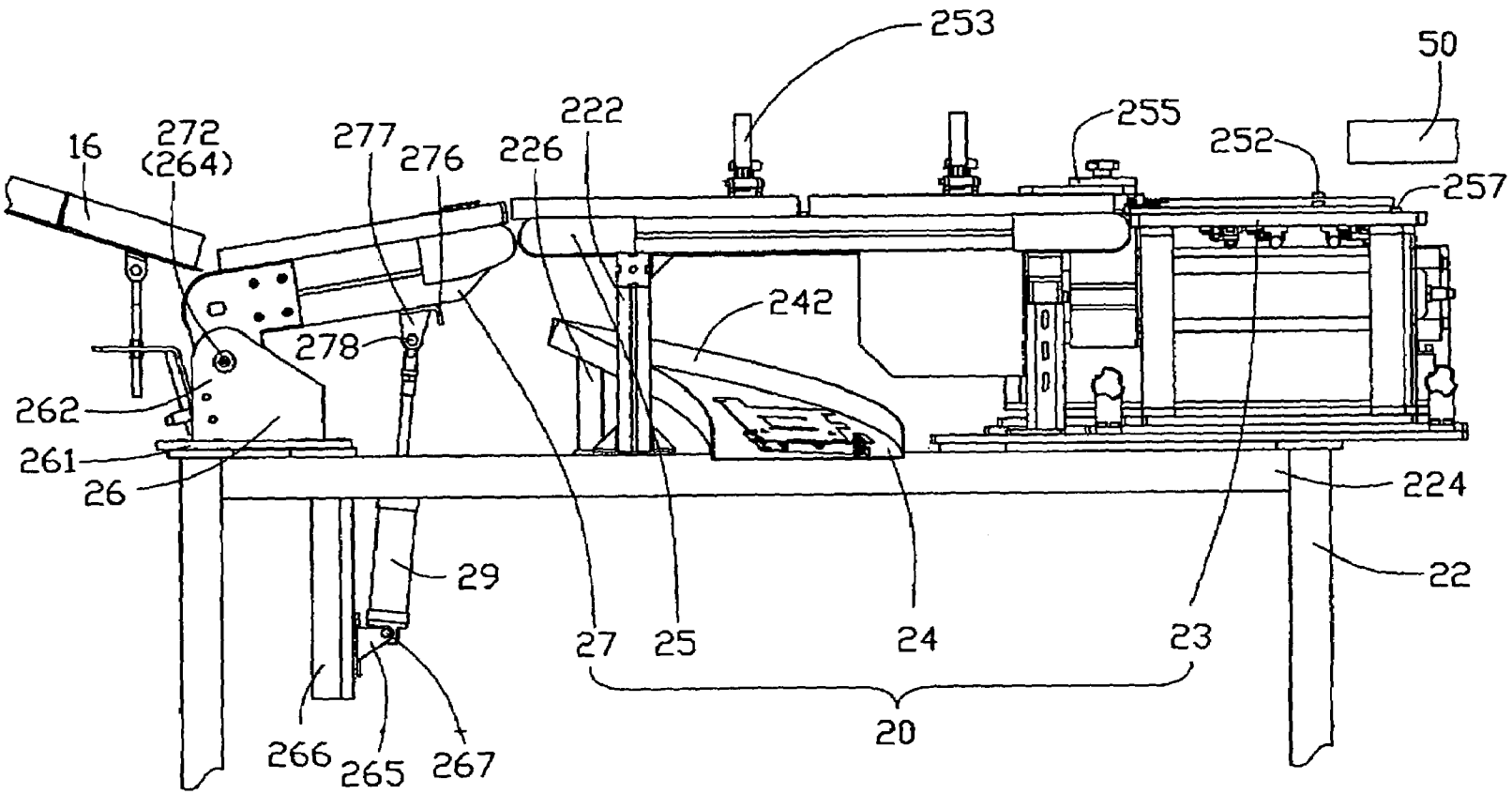
FIG. 1 is a front elevation view of an automatic feeding machine with switchable conveyor in accordance with the preferred embodiment of the present invention, showing an active conveyor of the automatic feeding machine mating with a passive conveyor thereof.
Figure 2:
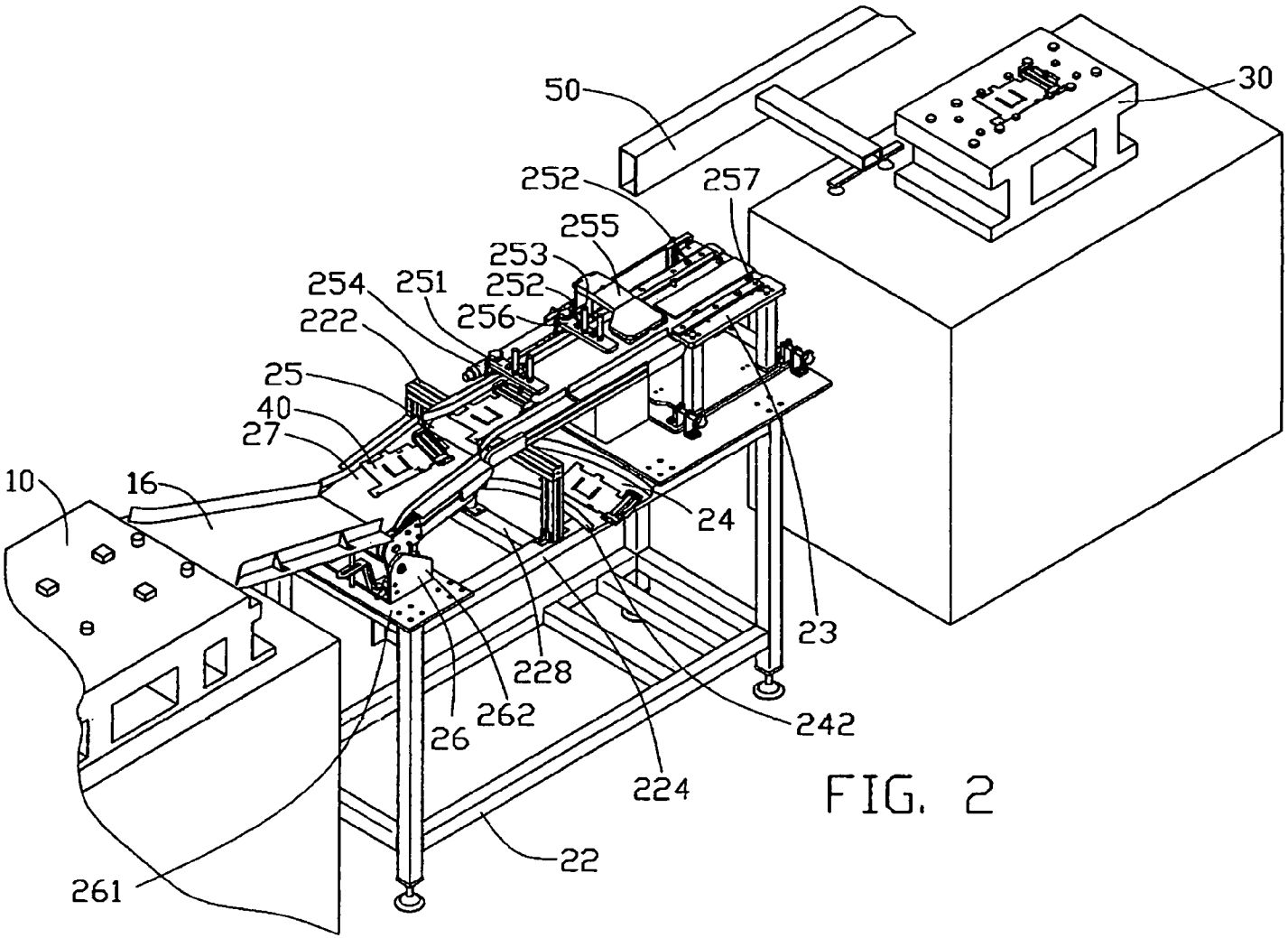
FIG. 2 is a perspective view of the automatic feeding machine of FIG. 1, together with a progressive die and a single station die on opposite sides thereof respectively.
Figure 3:
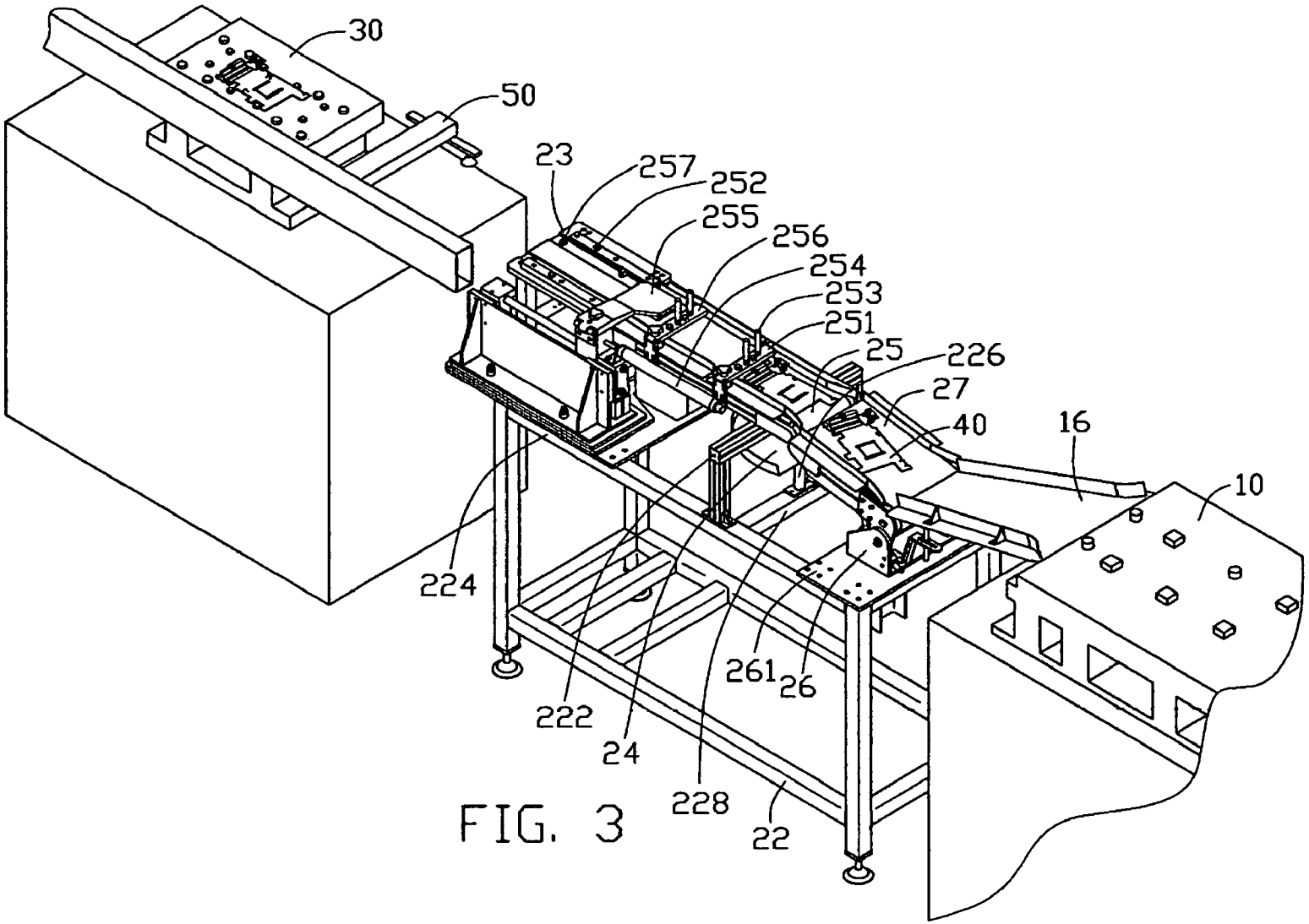
FIG. 3 is similar to FIG. 2, but viewed from another aspect.
Figure 4:
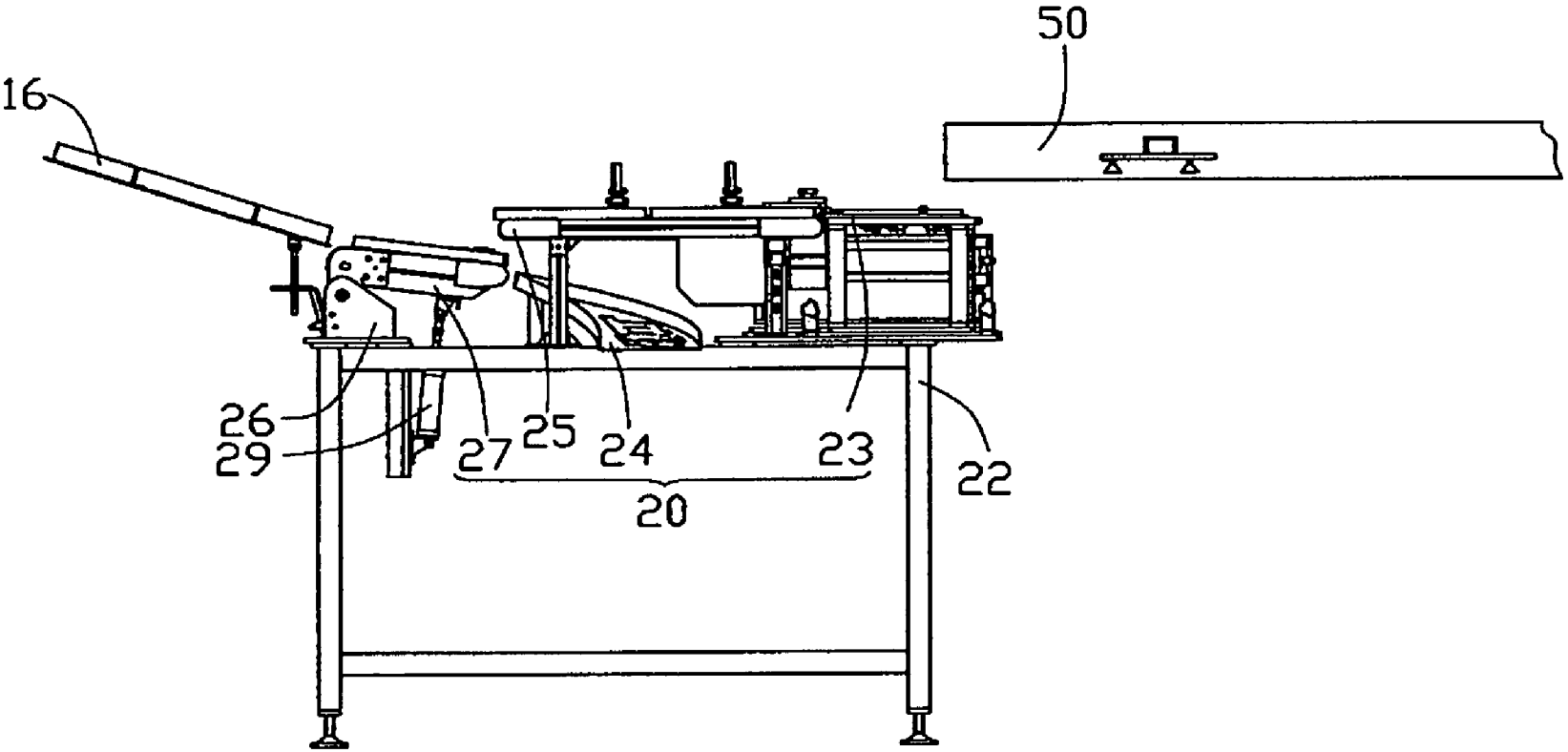
FIG. 4 is similar to FIG. 1, but reduced in size and showing the active conveyor mating with a curved slide of the automatic feeding machine.

Referring to FIGS. 1 to 4, an automatic feeding machine with switchable conveyor in accordance with a preferred embodiment of the present invention comprises a frame 22, a feeding device 20 and a manipulator 50. The feeding device 20 is positioned between a progressive die 10 and a single station die 30. The manipulator 50 is positioned between the feeding device 20 and the single station die 30.

The progressive die 10 is connected to the feeding device 20 via a straight slide 16. A continuous series of semi-manufactured products 40 is formed by repeated stamping of a moving metal sheet by the progressive die 10. The semi-manufactured products 40 slide to the feeding device 20 along the straight slide 16.

The feeding device 20 is positioned on the frame 22, and comprises a curved slide 24, an active conveyor 27, a passive conveyor 25 and a locating table 23. The active conveyor 27 and the passive conveyor 25 each comprise an endless moving belt system to provide conveyance.

A U-shaped girder 222 is attached on a pair of main beams 224 of the frame 22, so that it straddles the main beams 224. A crossbeam 228 interconnects the main beams 224 near the U-shaped girder 222. A supporting post 226 extends upwardly from a middle of the crossbeam 228. A pedestal 26 is mounted on a left end of the frame 22. The pedestal 26 comprises a base board 261, and a pair of symmetrically opposite side plates 262 extending upwardly from the base board 261. A pivot aperture 264 is defined in each side plate 262. A transverse fixed board 266 extends downwardly from an inner side of the base board 261. A generally U-shaped first bracket 265 is mounted on an inmost side of the fixed board 266. A pair of aligned first pivot holes 267 is defined in the first bracket 265.

The curved slide 24 is mounted between the supporting post 226 and a front one of the main beams 224. Two baffle flanges 242 are bent upwardly from opposite lateral sides of the curved slide 24 respectively.

A pair of pivots 272 is pivotably engaged in the pivot apertures 264 of the pedestal 26, so that the active conveyor 27 is pivotably connected with the pedestal 26. A connecting board 276 is secured to a right part of an underside of the active conveyor 27. A pair of second brackets 277 extends downwardly from the connecting board 276. A second pivot hole 278 is defined in each second bracket 277. A bottom end of a first cylinder assembly 29 is pivotably connected to the first bracket 265 via the first pivot holes 267. A top end of the first cylinder assembly 29 is pivotably connected to the second brackets 277 via the second pivot holes 278. The first cylinder assembly 29 is controlled by an electrical system (not shown).

One end of the passive conveyor 25 is secured on the U-shaped girder 222, and the other end is connected to the locating table 23. Two spaced, transverse cantilevers 251, 256 extend from a same long side of the passive conveyor 25, such that they are disposed horizontally a predetermined distance above the passive conveyor 25. A pair of vertical second cylinder assemblies 253 and a pair of sensors 252 is provided on each cantilever 251, 256. Furthermore, a third cylinder assembly 254 is arranged alongside and parallel to said long side of the passive conveyor 25. The third cylinder assembly 254 is connected to a driving board 255.

The locating table 23 is secured on a right side of the frame 22. A plurality of baffle posts 257 protrudes upwardly from an end of the locating table 23 that is adjacent the single station die 30. A pair of sensors 252 is positioned on opposite lateral sides of the locating table 23 respectively.

In operation, each semi-manufactured product 40 freshly stamped by the progressive die 10 slides to the active conveyor 27 along the straight slide 16. The semi-manufactured product 40 is transferred to the passive conveyor 25 by the active conveyor 27, and is transported along the passive conveyor 25. When the sensors 252 of the cantilevers 251, 256 detect that no semi-manufactured products 40 are under either of the cantilevers 251, 256, piston rods (not labeled) of the second cylinder assemblies 253 are in retracted positions, to allow a series of semi-manufactured products 40 to be continuously transported along the passive conveyor 25. At the same time, the electronic system controls the third cylinder assembly 254 to drive the driving board 255 to push a leading one of the semi-manufactured products 40 to the locating table 23. The semi-manufactured product 40 is stopped by the baffle posts 257 of the locating table 23, and is then taken away by the manipulator 50 to the single station die 30 for further processing. A frequency of stamping of the progressive die 10 is greater than a frequency of processing of the single station die 30. As a result, the passive conveyor 25 becomes fully occupied with a plurality of semi-manufactured products 40 after a period of time. At this point in time, the sensors 252 of the cantilevers 251, 256 and the locating table 23 all detect the presence of semi-manufactured products 40. The sensors 252 send corresponding signals to the electronic system, which controls the piston rods of the second cylinder assemblies 253 of the cantilevers 251, 256 to extend downwardly in order to block semi-manufactured products 40 from traveling along the passive conveyor 25. At this time, the belts of the active conveyor 27 and the passive conveyor 25 are still moving, and the belt of the passive conveyor 25 skids under semi-manufactured products 40 that are blocked by the piston rods of the second cylinder assemblies 253. Simultaneously, the electronic system controls a piston rod (not labeled) of the first cylinder assembly 29 to retract, so that the active conveyor 27 pivots to a position in alignment with the curved slide 24. Thereafter, semi-manufactured products 40 sliding down the straight slide 16 are transported by the active conveyor 27 to the curved slide 24. The semi-manufactured products 40 slide out from the curved slide 24, and are collected by an operator. Thus the passive conveyor 25 does not become jammed with semi-manufactured products 40. When the sensors 252 detect that the number of semi-manufactured products 40 on the locating table 23 is reduced, the sensors 252 send corresponding signals to the electronic system. The electronic system controls the piston rod (not labeled) of the first cylinder assembly 29 to extend, so that the active conveyor 27 pivots upwardly to a position in alignment with the passive conveyor 25 once again. Thereupon, semi-manufactured products 40 continue to be transported in the normal way as described above. At a later time, the operator can stop the progressive die 10, and put the collected semi-manufactured products 40 on the passive conveyor 25 for transportation.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An automatic feeding machine for transferring partly-manufactured products between two machines operating at different frequencies, the automatic feeding machine comprising:

a frame;

a first slide for transferring said products;

a feeding device mounted on the frame, the feeding device comprising:

an active conveyor pivotally connected to a left side of the frame, the active conveyor having a first end receiving said products from the first slide, and transferring said products to an opposite second end thereof;

a passive conveyor secured on the frame and receiving said products from said second end of the active conveyor;

a stopping device located above said passive conveyor for stopping movement of said products along said passive conveyor;

a locating table secured on a right side of the frame, receiving said products;

a plurality of sensors detecting said products; and a second slide positioned on the frame;

wherein when the passive conveyor is fully occupied with said products, the active conveyor pivots to a position in alignment with the second slide so that unneeded said products slide out along the second slide.

2. The automatic feeding machine as claimed in claim 1, wherein a pedestal is positioned on a left side of the frame, and the active conveyor is pivotally supported by the pedestal.

3. The automatic feeding machine as claimed in claim 2, wherein the pedestal comprises a base board, and a pair of symmetrically opposite side plates extending upwardly from the base board, each of the side plates defining a pivot aperture therein.

4. The automatic feeding machine as claimed in claim 3, wherein a fixed board is located under the frame, a first cylinder assembly is pivotally secured to the fixed board, and a piston rod of the first cylinder assembly is pivotally connected to an end of the active conveyor that is adjacent the passive conveyor.

5. The automatic feeding machine as claimed in claim 4, wherein at least one of the sensors is located above the passive conveyor, and when said at least one of the sensors detects said second end of the active conveyor pivot to communicate with the second slide.

6. The automatic feeding machine as claimed in claim 1, wherein a plurality of the sensors is located above the passive conveyor and spaced apart from each other, said stopping device comprising at least a second cylinder assembly, and wherein when said plurality of the sensors all detect said products under said second cylinder assembly, said second cylinder assembly stops movement of said products along the passive conveyor.

7. The automatic feeding machine as claimed in claim 1, wherein a third cylinder assembly is located beside the passive conveyor, a driving board is connected to the third cylinder assembly, and the third cylinder assembly controls the driving board to transfer said products on the passive conveyor to the locating table.

8. The automatic feeding machine as claimed in claim 7, further comprising a manipulator, for moving said products from the locating table to a single station die.

9. An automatic feeding machine assembly comprising:

a progressive die for continuously stamping a raw material to form a continuous series of partly-manufactured products;

a frame;

a feeding device mounted on the frame, the feeding device comprising a first slide for receiving said products from the progressive die, an active conveyor, a passive conveyor, a locating table, a plurality of sensors for detecting said products, and a controlling device connected to a driving board for controlling the driving board to transfer said products on the passive conveyor to the locating table;

a manipulator for removing said products from the locating table; and a single station die receiving said products from the manipulator for further processing, a frequency of operation of the single station die being less than a frequency of operation of the progressive die;

wherein when the passive conveyor is fully occupied with said products, the active conveyor pivots to a position away from the passive conveyor so that unneeded said products do not reach the passive conveyor.

10. The automatic feeding machine assembly as claimed in claim 9, wherein a fixed board is located under the frame, a cylinder assembly is pivotally secured to the fixed board, and a piston rod of the cylinder assembly is pivotally connected to an end of the active conveyor that is adjacent the passive conveyor.

11. The automatic feeding machine assembly as claimed in claim 9, wherein the controlling device comprise a cylinder assembly assembled beside the passive conveyor.

12. The automatic feeding machine assembly as claimed in claim 9, further comprising a second slide, wherein when the active conveyor pivots to said position, the second slide is in alignment with the active conveyor for receiving unneeded said products.

13. An automatic feeding machine assembly comprising:

a progressive die for continuously stamping a raw material to form a continuous series of partly-manufactured products;

a frame;

a feeding device mounted on the frame, the feeding device receiving said products from the progressive die, an active conveyor, a passive conveyor, a locating table; and a stopping device located above said passive conveyor for stopping movement of said products along said passive conveyor;

a manipulator for removing said products from the locating table; and a single station die receiving said products from the manipulator for further processing;

wherein when the passive conveyor is fully occupied with said products, the active conveyor moves to a position away from the passive conveyor so that unneeded said products do not reach the passive conveyor.

14. The automatic feeding machine assembly as claimed in claim 13, further comprising a curved slide for receiving said products from the active conveyor when the passive conveyor is fully occupied with said products.

15. The automatic feeding machine assembly as claimed in claim 13, further comprising a plurality of sensors detecting said products.

16. The automatic feeding machine assembly as claimed in claim 15, wherein the stopping device comprises at least a cylinder assembly, and when said plurality of the sensors all detect said products under said cylinder assembly, said cylinder assembly stops movement of said products along the passive conveyor.

* * * * *